US006406309B1

(12) United States Patent
Ennis et al.

(10) Patent No.: US 6,406,309 B1
(45) Date of Patent: Jun. 18, 2002

(54) ENHANCED ARRANGEMENT FOR DISENGAGING AND SEPARATING TWO MATED COMPONENTS

(75) Inventors: Amanda Elisa Ennis, Rochester; Michael Scott Good, Fountain, both of MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/672,095

(22) Filed: Sep. 29, 2000

(51) Int. Cl.[7] ..... H01R 13/62

(52) U.S. Cl. ..... 439/152; 439/74; 439/65; 439/155; 439/157

(58) Field of Search ..... 439/152, 155, 439/160, 74, 65, 157

(56) References Cited

U.S. PATENT DOCUMENTS 3,209,303 A * 9/1965 Uberbacher ..... 439/155
3,784,954 A * 1/1974 Grimm et al. ..... 439/160
5,476,391 A * 12/1995 Katsuma ..... 439/157
6,224,405 B1 * 5/2001 Eland ..... 439/152

* cited by examiner

*Primary Examiner*—Tho D. Ta
(74) *Attorney, Agent, or Firm*—Robert H. Berdo, Jr.

(57) ABSTRACT

A parallel-plugged planar sandwich arrangement for a computer system includes a first printed circuit board having a first electrical connector on a surface thereof, and a second printed circuit board having a second electrical connector on a surface thereof. The second electrical connector is electrically mated to the first electrical connector, to electrically couple the first printed circuit board to the second printed circuit board. A stiffener panel is disposed between the first printed circuit board and the second printed circuit board. A disengagement mechanism is attached to the panel and includes a cam assembly that has a cam rotatable about an axis of rotation, a cam pin projecting out from opposite sides of the cam and being coaxial with the axis of rotation, and a torsional helical spring disposed around the cam pin for automatically rotating the cam in a first direction. A handle is attached to the cam. When the handle is pulled, the cam is rotated in a second direction opposite to the first direction so that the cam is caused to push against the first printed circuit board, thereby removing the first electrical connector from engagement with the second electrical connector while moving the first printed circuit board in a direction away from the second printed circuit board.

26 Claims, 7 Drawing Sheets

ENHANCED ARRANGEMENT FOR DISENGAGING AND SEPARATING TWO MATED COMPONENTS

Background of the Invention

1. Field of the Invention

The invention relates to an enhanced arrangement for disengaging and separating two mated components, such as two mated parallel printed circuit boards of a computer.

2. Background Information

Computer systems typically include a number of printed circuit boards that are electrically coupled together. One way to accomplish this is to use electrical cables to electrically join respective printed circuit boards. The cables are typically connected to plug connections disposed on the surface of the respective printed circuit boards. The cables allow various electrical signals to be transmitted from one printed circuit board to the other printed circuit board, for example, so that various electronic components on one printed circuit board can communicate with electronic components on the other printed circuit board.

One problem with the cabling scheme is that the distance that the electrical signals must travel may be relatively far. Since the distance the signals must travel may be great, the associated signal response time may be slow. To reduce this distance, the respective printed circuit boards can be directly connected to one another. For example, one printed circuit board may be provided with a slot in which another printed circuit board may be inserted. Using this arrangement, the two boards are perpendicular to each other when "mated" together. Beyond the distance advantage described above, this arrangement has the further advantage of easy insertion and removal of one card from the other.

While this perpendicular arrangement does have certain advantages, various computer system constraints limit greatly the extent to which this arrangement can be used.

Thus, it is also known to arrange the two printed circuit boards over each other. In this configuration, one of the printed circuit boards is provided, for example, with a female type plug on its surface, and the other printed circuit board is provided with a male type plug on its surface. The female type plug and the male type plug are typically aligned with each other, so that when the one printed circuit board is disposed over the other printed circuit board, the respective plugs can be electrically engaged with each other, thus electrically coupling the printed circuit boards to each other.

This arrangement can be easily assembled, simply by pressing the boards together in a region of the plugs. However, the disassembly of the arrangement can cause the printed circuit boards and/or their respective plugs to become damaged. That is, to disassemble this arrangement, it is conventional to grip the edges of the respective printed circuit boards, in an attempt to pull them apart and disengage their respective plugs. However, one problem with this approach is that this action will cause the boards to flex relative to their point(s) of attachment, i.e., at the respective plugs. Moreover, the greater the distance from the plugs to the edge of the printed circuit board(s) that is being grasped, the greater the flexing of the printed circuit board(s). While printed circuit boards can withstand a slight flexing without permanent damage, if the flexing becomes too great, the printed circuit board may crack, and/or the respective wirings of the printed circuit board may shear, rendering the printed circuit board(s) inoperative. Moreover, the flexing of the printed circuit boards may cause electronic components to pop off from the surface of the flexed printed circuit board, rendering the printed circuit board defective.

Moreover, this method of disengaging and separating the printed circuit boards has the problem of asymmetrically applying the separation force, i.e., only on one side of the plugs. The applied force may therefore cause the plugs to rotate, which may cause the respective conductive pins of the plugs to bend and/or break.

Thus, there is a need for an arrangement that will allow two superposed, mated printed circuit boards to be easily disengaged and separated from each other without flexing the respective printed circuit boards.

Further, there is a need for an arrangement that will allow two superposed, mated printed circuit boards to be disengaged and separated from each other without asymmetrically applying a force relative to a plug or other connector that electrically couples the two printed circuit boards together.

SUMMARY OF THE INVENTION

It is, therefore, a principle object of this invention to provide an enhanced arrangement for disengaging and separating two mated components.

It is another object of the invention to provide an enhanced arrangement for disengaging and separating two mated components that solves the above mentioned problems.

These and other objects of the present invention are accomplished by the enhanced arrangement for disengaging and separating two mated components disclosed herein.

In an exemplary aspect of the invention, a disengagement mechanism is used to separate two superposed printed circuit boards from each other, by causing their respective electrical connectors to disengage. This advantageously allows the printed circuit boards to be easily separated, without damaging their respective electrical connectors or other components thereof.

In another exemplary aspect of the invention, a stiffener panel is provided with grooved recesses provided on opposite sides of a hole therein, so as to receive various components of the disengagement mechanism. This allows the components of the disengagement mechanism to be nested within the stiffener panel, thus advantageously minimizing wasted space.

In an exemplary aspect of the invention, the disengagement mechanism includes two cam assemblies. Each cam assembly includes an elliptically-shaped cam disposed to rotate within a respective grooved recess. Each cam assembly further includes a pair of pins projecting out from opposite sides of the respective cam, and being disposed within a respective pin-accommodating portion. The pins are disposed offset toward one end of the respective cam, so that another portion of the cam that is disposed furthest away from an axis of rotation, which extends through the respective pins of the cam assembly, will define a high point of the cam. As such, when the cam assembly is rotated in a first direction about the axis of rotation, the high point of the cam will rotate to a position that projects above a surface of the stiffener panel (i.e., above an upper edge of a lip of the panel). Further, when the cam assembly is rotated in an opposite, second direction about the axis of rotation, the high point of the cam will rotate to a position that is level with or below the surface of the stiffener panel. This configuration allows the disengagement mechanism to be easily utilized with a planar sandwich arrangement, for separating the printed circuit boards and disengaging their respective mating components.

In order to retain the pins of the cam assembly within the respective pin-accommodating portions, a plurality of cover plates are provided. In an exemplary aspect of the invention, the cover plates are disposed directly over the respective cam assemblies and secured to the stiffener panel, using threaded fasteners, for example. Moreover, each cover plate has a hole formed therethrough, through which the high point of the cam may project when the cam is rotated about the axis of rotation. The cover plates advantageously allow the cam assemblies to be adapted for use with a stiffener panel.

In order to automatically rotate the cams in the second direction, so as to retract the high point of the cam level with or below the surface of the stiffener panel, each cam assembly is advantageously provided with a torsional helical spring. Preferably, each respective torsional helical spring is disposed about a respective pin. Moreover, each cam can be provided with a groove that surrounds the respective pin, in which the torsional helical spring can be at least partially accommodated.

As the cam is manually rotated against a force of the spring, for example, in the first direction so that the high point of the cam projects above the surface of the stiffener panel, the spring will exert a torque in the second direction. Thus, the spring advantageously allows the cam to be automatically rotated in the second direction, and fully retracts the mechanism into the stiffener panel.

In a further aspect of the invention, and in order to manually rotate the cam in the first direction, each cam is connected to a handle. For example, the high point of each cam can be connected with a single U-shaped handle, which when pulled, advantageously causes both cam assemblies to simultaneously rotate in the first direction.

In an exemplary aspect of the invention, the handle projects outward toward an edge of the stiffener panel. The outer peripheral lip of the stiffener panel can then be removed in a region of the handle, so as to allow access to the handle. Moreover, the handle can also be tailored to project beyond the outer edge of the stiffener panel. These features all allow easy access to the handle, so that it may be readily grasped by a user seeking to separate the printed circuit boards.

In use, the user simply pulls on the base of the handle, causing the cams to simultaneously rotate in the first direction, and moving the high points of the cams above the surface of the stiffener panel. Further, as the handle is pulled, the high points of the cams will simultaneously contact the lower surface of the upper printed circuit board, and subsequently begin urging the upper printed circuit board away from the stiffener panel and lower printed circuit board. Because of the symmetrical application of force on opposite sides of the electrical connectors, and due to the proximity of the cam assemblies to the connectors, the mating components of the connectors will smoothly disengage, without causing damage to the connectors or printed circuit boards.

After the printed circuit boards are fully separated, the handle is released, allowing the springs to automatically rotate the respective cams in the second direction. This advantageously causes the high points of the cams, corresponding holes, and ends of the handle to automatically move to a level even with or below the surface of the stiffener panel.

Moreover, the size and shape of the cam can be modified to meet the needs of the user. By increasing the distance from the high point of the cam to the axis of rotation, the mechanical advantage resulting from the cam will be increased. Thus, the cam assembly is scaleable and modifiable to other applications requiring greater (or lesser) disengagement forces.

DETAILED DESCRIPTION OF THE PREFERRED EMBODIMENTS

The invention will now be described in more detail by way of example with reference to the embodiments shown in the accompanying figures. It should be kept in mind that the following described embodiments are only presented by way of example and should not be construed as limiting the inventive concept to any particular physical configuration.

Further, if used and unless otherwise stated, the terms "upper", "lower", "front", "back", "over", "under", and similar such terms are not to be construed as limiting the invention to a particular orientation. Instead, these terms are used only on a relative basis.

Figure 1:
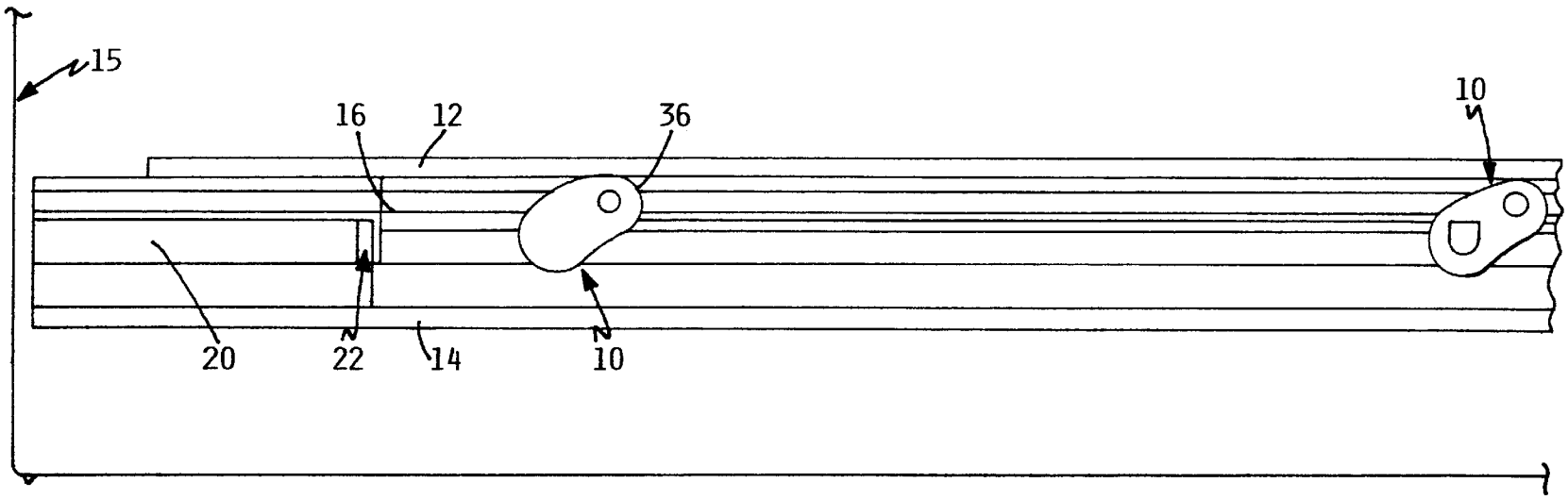
FIGS. 1 and 2 illustrate a disengagement mechanism, according to an exemplary aspect of the present invention, in use with a parallel-plugged planar sandwich assembly, showing the disengagement mechanism in respective deactivated and activated conditions.
Figure 2:
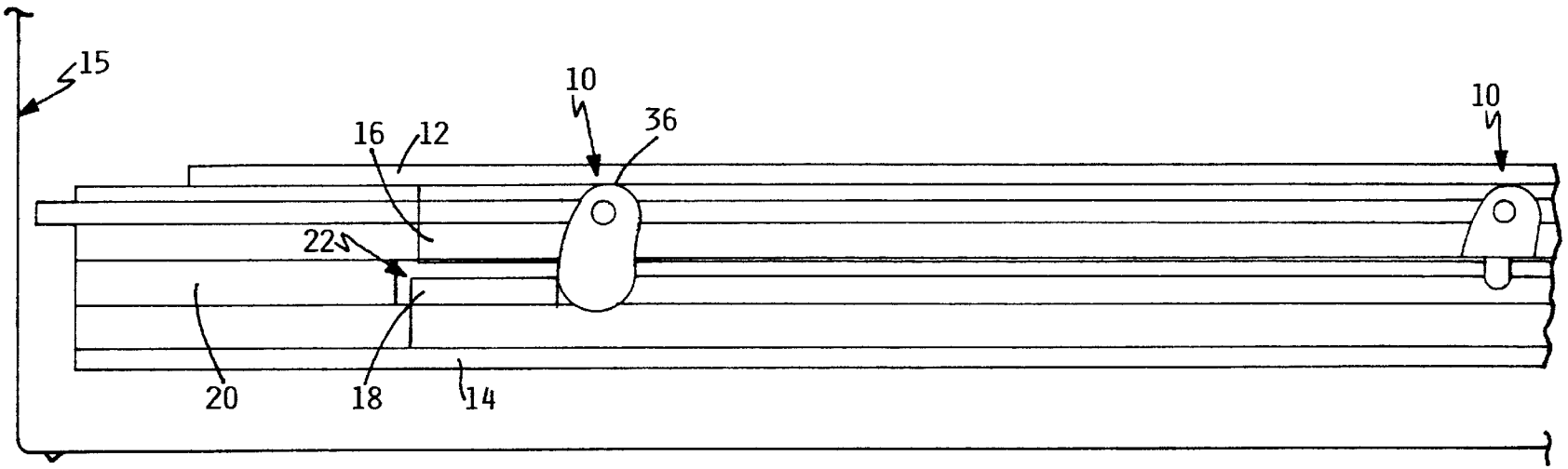

FIGS. 1 and 2 illustrate an exemplary embodiment of the invention, which includes a disengagement mechanism 10 disposed between two mated components, such as two superposed printed circuit boards 12, 14 of a parallel-plugged planar sandwich arrangement. This disengagement mechanism 10 and printed circuit boards 12, 14 are shown within a frame or housing 15 of a computer system. The exemplary disengagement mechanism 10 is used to separate the two superposed printed circuit boards 12, 14 from each other, by causing their respective electrical connectors 16, 18 to disengage. However, it will be appreciated that the present invention may be utilized to separate printed circuit boards that are mated together using means other than the described electrical connectors, and/or utilized to separate and/or disengage other types of mated components from each other.

By way of example, each printed circuit board 12, 14 is a laminated printed circuit board. The electrical connector 16 of one of the printed circuit boards 12 is a female type plug provided on a surface of the printed circuit board 12. The electrical connector 18 of the other printed circuit board 14 is a male type plug, for example, a plurality of upright conductive pins, provided on a surface of the printed circuit board. Of course, the relative arrangement of the electrical connectors 16, 18 can be reversed and other types of electrical connectors can be provided, without departing from the spirit and scope of the invention. Moreover, in this exemplary embodiment, the electrical connectors are high density electrical connectors, i.e., future buss or VHDM connectors. However, the invention can be utilized with other connectors, too.

The female type plug 16 and the male type plug 18 of the printed circuit board are aligned with each other, so that when one printed circuit board is disposed over the other printed circuit board, the respective plugs 16, 18 can be engaged with each other, thus electrically coupling the printed circuit boards to each other. As is conventional. in the exemplary embodiment, the female type plug 16 and the male type plug 18 are disposed somewhat toward a middle region of the respective printed circuit boards 12, 14, so as to help equalize the length of the signal paths on the respective printed circuit boards. However, the placement of the respective plugs on the printed circuit boards can be varied, without departing from the scope of the invention.

Furthermore, in order to provide support for the printed circuit boards 12, 14, the parallel-plugged planar sandwich assembly includes a stiffener panel 20 disposed between the respective superposed printed circuit boards 12, 14, and in a plane parallel thereto. The exemplary stiffener panel 20 is formed from an insulating material, so as to prevent inadvertent shorting with the wirings and electronic components of the printed circuit boards 12, 14. However, the stiffener panel can be formed of other materials, without departing from the spirit of the invention. Moreover, the stiffener panel 20 is also typically provided with a hole 22 therethrough, to allow passage of the male type plug 18 and/or the female type plug 16.

Figure 3:
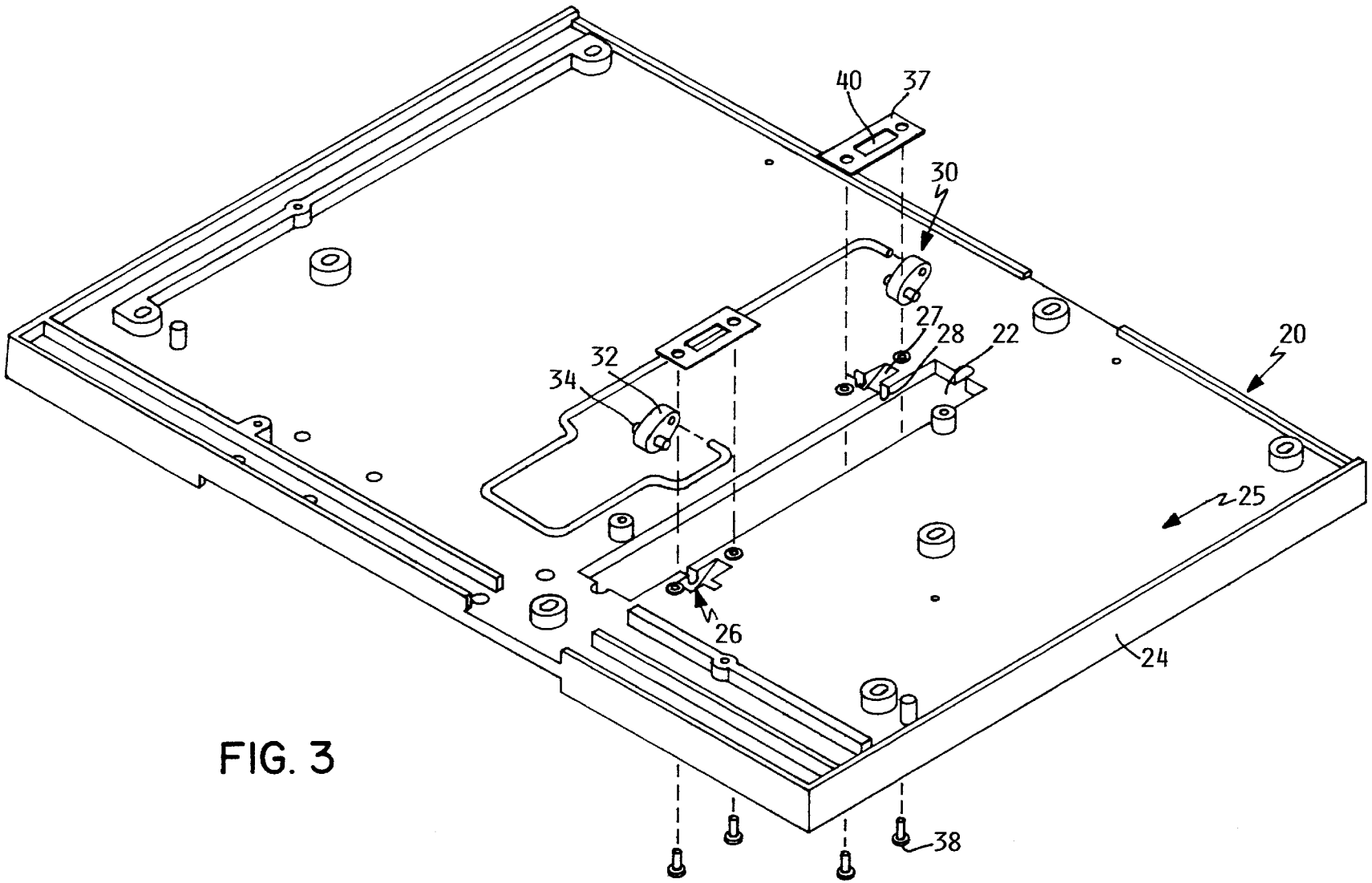
FIG. 3 is a perspective exploded view of the disengagement mechanism shown in FIG. 1, in conjunction with a stiffener panel of the parallel-plugged planar sandwich assembly.

Referring to FIG. 3, the stiffener panel 20 is typically provided with an outer peripheral lip 24, which defines two walls disposed on opposite sides of the stiffener panel 20, and around outer edges thereof. The lip 24 provides support for the respective printed circuit boards 12, 14, and defines respective recesses 25 that ensure that most of the major surface of the respective printed circuit boards is not in direct contact with the primary surface of the stiffener panel 20.

As shown in FIG. 3, the stiffener panel 20 is provided with grooved recesses 26 provided on opposite sides of the hole 22, so as to receive various components of the disengagement mechanism 10, as will be further described in the paragraphs that follow. The grooved recesses 26 have a primary portion 27 that extends in a direction parallel to a direction in which the hole 22 extends. In the exemplary embodiment, there are two grooved recesses 26, which are diametrically arranged on opposite sides of the hole 22. However, variations in the number, configuration and placement of the grooved recesses 26 are within the spirit and scope of the present invention.

Moreover, each grooved recess 26 includes a plurality of pin-accommodating portions 28, each of which extends perpendicular to, and crosses a respective primary portion 27. In the exemplary embodiment, each pin-accommodating portion 28 and respective primary portion 27 forms a cross-shape.

Figure 4:
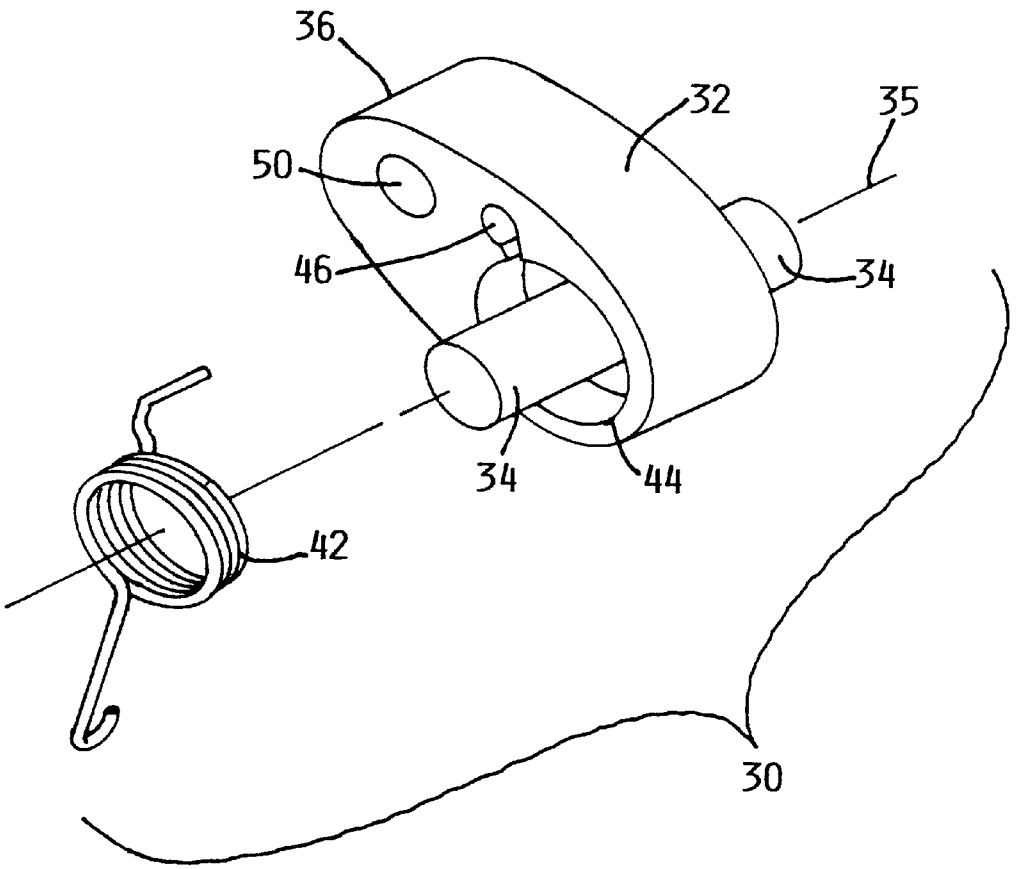
FIG. 4 is a perspective exploded view of the cam assembly of the disengagement mechanism shown in FIG. 1.
Figure 5:
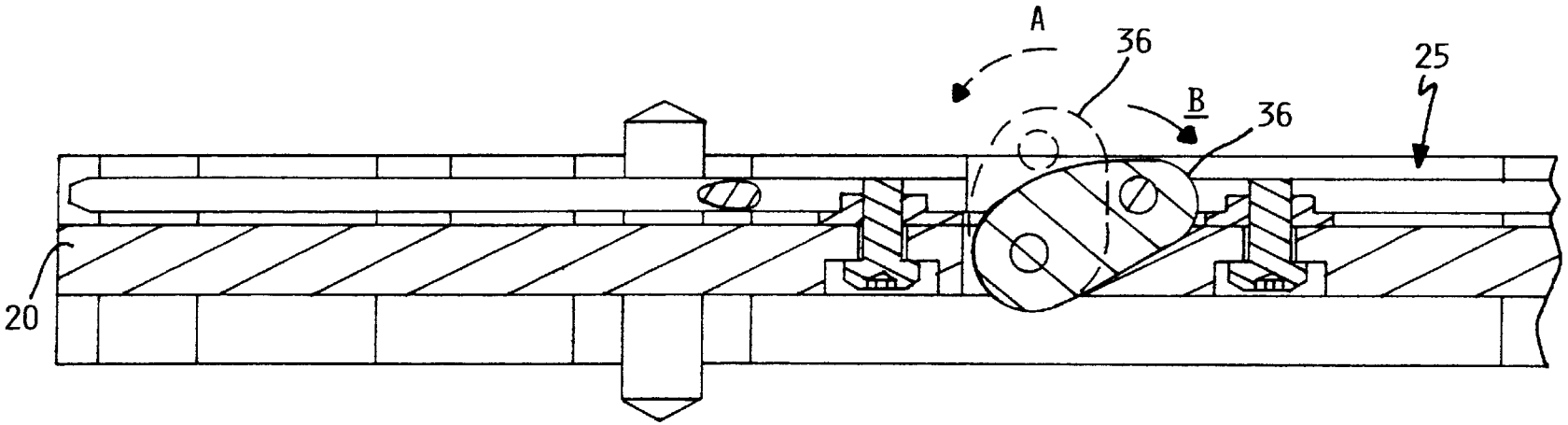
FIG. 5 is a sectional view of the disengagement mechanism shown in FIG. 1, in conjunction with the stiffener panel of the parallel-plugged planar sandwich assembly.

Referring also to FIG. 4, in an exemplary aspect of the invention, the disengagement mechanism 10 includes two cam assemblies 30. Each cam assembly 30 includes an elliptically-shaped cam 32 disposed to rotate within a respective grooved recess 26. Each cam assembly 30 further includes a pin, which may be embodied as a pair of pins 34, projecting out from opposite sides of the respective cam 32, and being disposed within a respective pin-accommodating portion 28. The pins 34 are disposed offset toward one end of the respective cam 32, so that another portion of the cam that is disposed furthest away from an axis of rotation 35, which extends through the respective pins of the cam, will define a high point 36 of the cam. As such, and as best shown in FIG. 5, when the cam 32 is rotated in a first direction A about the axis of rotation 35, the high point of the cam will rotate to a position that projects above a surface of the stiffener panel 20 (i.e., out of recess 25). Further, when the cam 32 is rotated in an opposite, second direction B about the axis of rotation 35, the high point 36 of the cam will rotate to a position that is level with or below the surface of the stiffener panel 20 (i.e., within recess 25).

Preferably, and referring back to FIG. 3, in order to retain the pins 34 of the cam 32 within the respective pin-accommodating portions 28, a plurality of cover plates 37 are provided. In the exemplary embodiment, the cover plates 37 are disposed directly over the respective cam assemblies 30 and secured to the stiffener panel 20, using threaded fasteners 38, for example. Moreover, each cover plate 37 has a hole 40 formed therethrough, through which the high point 36 of the cam 32 may project when the cam is rotated about the axis of rotation 35.

As shown in FIG. 4, in order to automatically rotate the cams 32 in the second direction, so as to retract the high point of the cam 32 level with or below the surface of the stiffener panel 20 (i.e., within the recess 25), each cam assembly 30 is provided with a spring, for example, a torsional helical spring 42. Preferably, each respective torsional helical spring 42 is disposed about a respective pin 34. Moreover, each cam 32 can be provided with a groove 44 that surrounds the respective pin 34, in which the torsional helical spring 42 can be at least partially accommodated.

Each torsional helical spring 42 has two ends, with one end being engaged with the cam 32, and the other end being engaged with the stiffener panel 20 (now shown in this Figure). For example, the cam 32 can be provided with a hole or groove 46 for receiving one end of the spring 42, and the other end of the spring can be hooked to engage with an edge of the stiffener panel 20 in a region of the hole 22. Other manners of coupling the spring 42 to the cam 32 and the stiffener panel 20 are within the spirit and scope of the invention.

As the cam 32 is manually rotated against a force of the spring 42, for example, in the first direction so that the high point of the cam 32 projects above the surface of the stiffener panel 20, the spring will exert a torque in the second direction. Thus, the spring 42 allows the cam 32 to be automatically rotated in the second direction. Other means of automatically rotating the cam 32 are also within the scope of the invention.

Figure 6:
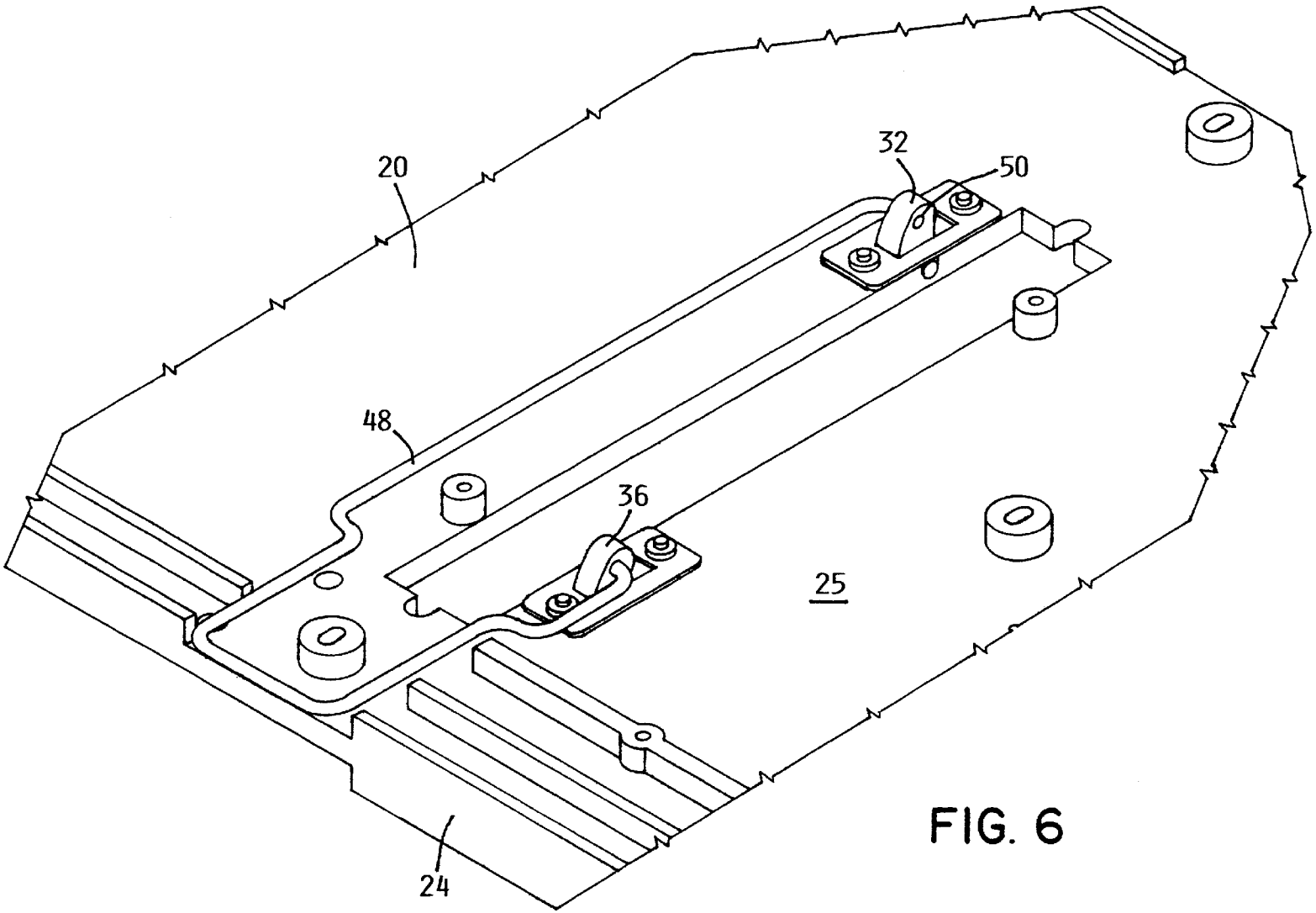
FIGS. 6 and 7 are perspective views of the disengagement mechanism shown in FIG. 1, in conjunction with the stiffener panel of the parallel-plugged planar sandwich assembly, illustrating the disengagement mechanism in respective activated and deactivated conditions.
Figure 7:
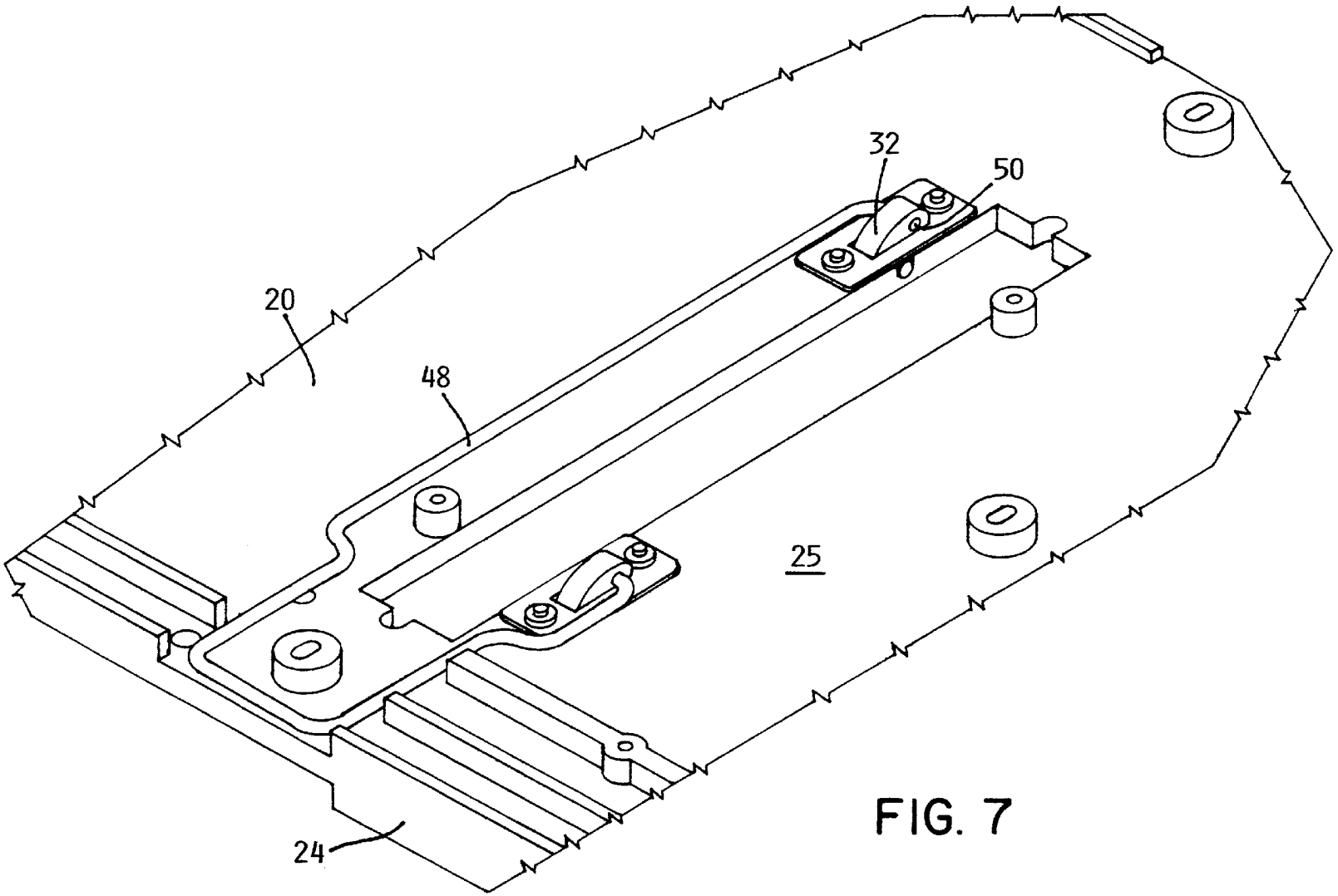

Referring also to FIGS. 6 and 7, in order to manually rotate the cam 32 in the first direction, the disengagement mechanism 10 includes a handle 48. Each cam 32 is shown connected to the handle 48. For example, the high point 36 of each cam 32 can be connected with a single U-shaped handle 48, which when pulled, causes both cam assemblies 30 to simultaneously rotate in the first direction. Although this configuration is particularly advantageous, each cam 32 may instead be connected to a discrete handle (not shown). Moreover, the handle can have other shapes and configurations without departing from the spirit of the invention.

In the exemplary embodiment, each cam 32 has a hole 50 formed in a region of the high point 36. Respective ends of the handle 48 can be positioned therein. Thus, when the handle 48 is pulled to the position shown in FIG. 6, the cam assembly 30 is activated, causing the high points of the cams 32, corresponding holes 50, and ends of the handle 48 to move above the surface of the stiffener panel 20, i.e., higher than an upper edge of lip 24, and out of recess 25. When the handle 48 is released, the springs 42 rotate the respective cams 32 in the second direction, causing the high points of the cams 32, corresponding holes 50, and ends of the handle 48 to be moved to a level even with or below the upper edge of lip 24, and within recess 25. Thus, this arrangement advantageously moves the components of the disengagement mechanism 10 into a nesting relationship within the stiffener panel 20, when not in use.

In an exemplary aspect of the invention, the handle 48, in a region of the base of the U-shape, projects outward toward an outer edge of the stiffener panel 20. The outer peripheral lip 24 of the stiffener panel 20 can then be removed in a region of the handle 48, so as to allow access to the handle. Moreover, the handle 48 can also be tailored to project beyond the outer edge of the stiffener panel 20. These features all allow easy access to the handle 48, so that it may be readily grasped by a user seeking to separate the printed circuit boards 12, 14.

In use, the user simply pulls on the base of the handle 48, causing the cams 32 to simultaneously rotate, and moving the high points 36 of the cams above the surface of the stiffener panel 20. Further, as the handle 48 is pulled, the high points 36 of the cams 32 will simultaneously contact the lower surface of the upper printed circuit board 12, and subsequently begin urging the upper printed circuit board away from the stiffener panel 20 and lower printed circuit board 14. Because of the symmetrical application of force on opposite sides of the electrical connectors 16. 18, and due to the proximity of the cam assemblies 30 to the connectors, the mating components of the connectors will smoothly disengage, without causing damage to the connectors or other features of the printed circuit boards.

After the printed circuit boards 12, 14 are fully separated, the handle 48 is released, allowing the springs 42 to rotate the respective cams 32 in the second direction. This causes the high points of the cams 32, corresponding holes 50, and ends of the handle 48 to move to a level even with or below the surface of the stiffener panel 20.

Moreover, due to the configuration of the stiffener panel 20, and the ability of the springs 42 to fully retract the mechanism into the stiffener panel, the invention does not require any additional space.

It should be understood, however, that the invention is not necessarily limited to the specific arrangement and components shown and described above, but may be susceptible to numerous variations within the scope of the invention. For example, the size and shape of the cams can be modified to meet the needs of the user. By increasing the distance from the high point of the cam to the axis of rotation, the mechanical advantage resulting from the cam will be increased. Thus, the cam assembly is scaleable and modifiable to other applications requiring greater (or lesser) disengagement forces.

It will be apparent to one skilled in the art that the manner of making and using the claimed invention has been adequately disclosed in the above-written description of the preferred embodiments taken together with the drawings.

It will be understood that the above description of the preferred embodiments of the present invention are susceptible to various modifications, changes, and adaptations, and the same are intended to be comprehended within the meaning and range of equivalents of the appended claims.

What is claimed is:

1. A disengagement arrangement, comprising:

a first component;

a second component mated to the first component; and a disengagement mechanism that, when activated, moves the first component away from the second component so as to disengage the first component from the second component;

wherein said first component comprises a first printed circuit board having an electrical connector on a surface thereof, said second component being mated to said first printed circuit board via the electrical connector;

wherein said second component comprises a second printed circuit board having a further electrical connector on a surface thereof, said further electrical connector of said second printed circuit board removably engaging with said electrical connector of said first printed circuit board to electrically couple said first printed circuit board to said second printed circuit board; and wherein said first printed circuit board is arranged to be essentially parallel to, and superposed to said second printed circuit board.

2. The disengagement arrangement of claim 1, further comprising a panel disposed between said first printed circuit board and said second printed circuit board, said disengagement mechanism being attached to said panel.

3. The disengagement arrangement of claim 2, wherein said panel has a hole therethrough to allow said further electrical connector of said second printed circuit board to removably engage with said electrical connector of said first printed circuit board.

4. The disengagement arrangement of claim 3, wherein said disengagement mechanism includes at least one cam assembly disposed adjacent to the hole, said cam assembly including a cam rotatable about an axis of rotation, whereby rotation of said cam causes said cam to push against the first printed circuit board, thereby removing said further electrical connector of said second printed circuit board from engagement with said electrical connector of said first printed circuit board.

5. The disengagement arrangement of claim 4, wherein said cam assembly has a cam pin projecting out from opposite sides of said cam, said cam pin being coaxial with the axis of rotation.

6. The disengagement arrangement of claim 5, wherein said cam assembly further comprises means for automatically urging said cam to a position in which the cam is free of engagement with the first printed circuit board.

7. The disengagement arrangement of claim 6, wherein said means for automatically urging comprises a torsional helical spring disposed around said cam pin.

8. The disengagement arrangement of claim 7, wherein said panel includes a groove therein, said cam being received within the groove in a nesting relationship, and wherein said spring moves said disengagement mechanism into a nesting relationship within said panel.

9. The disengagement arrangement of claim 8, wherein said cam pin and said torsional helical spring are disposed within the groove.

10. The disengagement arrangement of claim 9, further comprising a cover plate disposed over the groove and fastened to said panel, so as to retain said cam pin and said torsional helical spring within the groove.

11. The disengagement arrangement of claim 10, wherein said cover plate has a hole therein, said cam projecting through the hole within said cover plate when said cam is rotated.

12. The disengagement arrangement of claim 6, wherein said disengagement mechanism comprises a handle attached to said cam, whereby movement of said handle causes said cam to rotate and push against the first printed circuit board.

13. The disengagement arrangement of claim 12, wherein said handle is accessible from between said first printed circuit board and said second printed circuit board, and wherein when said handle is pulled, said cam to rotated to push against the first printed circuit board.

14. The disengagement arrangement of claim 13, wherein said at least one cam assembly comprises at least two cam assemblies disposed on opposite sides of the hole, said handle being connected to said cams of said at least two cam assemblies, so that when said handle is pulled, said cams are simultaneously rotated.

15. A disengagement arrangement, comprising:

a panel having a through hole, through which a first electrical connector that is disposable on one side of said panel, may be removably engaged with a second electrical connector that is disposable on another side of said panel, said panel further having at least one grooved recess disposed adjacent to the through hole and formed in a major surface of, and on the one side of, said panel;

at least one cam assembly, including a cam rotatable about an axis of rotation, said cam being disposed in the at least one grooved recess, said cam having a hole formed therein; and a handle having one end inserted into the hole in said cam, said handle being pullable in an essentially linear direction that is essentially parallel to the major surface of said panel to cause said cam to rotate within the at least one grooved recess and about the axis of rotation, thereby causing the first electrical connector to become disengaged from the second electrical connector.

16. The disengagement arrangement of claim 15, wherein the hole has an elongated configuration, wherein the at least one grooved recess comprises at least two grooved recesses disposed on diametrically opposite sides of the hole so that the grooved recesses are not disposed directly across from each other, and wherein said at least one cam assembly comprises at least two cam assemblies, each having a cam disposed in a respective grooved recess, said handle being connected to said cams of said at least two cam assemblies, so that when said handle is pulled, said cams are simultaneously rotated in the first direction.

17. The disengagement arrangement of claim 15, wherein said cam assembly has a cam pin projecting out from opposite sides of said cam, said cam pin being coaxial with the axis of rotation.

18. The disengagement arrangement of claim 17, wherein when said handle is pulled, said cam rotates in a first direction; said cam assembly further comprising means for automatically rotating said cam in a second direction opposite to the first direction when said handle is released.

19. The disengagement arrangement of claim 17, wherein said means for automatically rotating comprises a torsional helical spring disposed around said cam pin.

20. The disengagement arrangement of claim 18, wherein the at least one grooved recess comprises at least two grooved recesses, each being disposed on an opposite side of the hole, and wherein said at least one cam assembly comprises at least two cam assemblies, each having a cam disposed in a respective grooved recess, said handle being connected to said cams of said at least two cam assemblies, so that when said handle is pulled, said cams are simultaneously rotated in the first direction.

21. The disengagement arrangement of claim 18, wherein the at least one grooved recess has a primary portion in which said cam is disposed, and has a plurality of pin-accommodating portions each extending perpendicular to the primary portion to form a cross-shape, and wherein each cam pin is disposed in a respective pin-accommodating portion.

22. The disengagement arrangement of claim 21, further comprising a cover plate disposed over the pin-accommodating portions for retaining said cam pins in the respective pin-accommodating portions when said cam is rotated about the axis of rotation.

23. The disengagement arrangement of claim 22, wherein said cover plate has a hole therein, said cam projecting through the hole within said cover plate when said cam is rotated about the axis of rotation.

24. A parallel-plugged planar sandwich arrangement for a computer system, comprising:

A) a first printed circuit board having a first electrical connector on a surface thereof;

B) a second printed circuit board having a second electrical connector on a surface thereof, said second printed circuit board being essentially parallel and superposed to said first printed circuit board, said second electrical connector being electrically mated to said first electrical connector, to electrically couple said first printed circuit board to said second printed circuit board;

C) a stiffener panel disposed between said first printed circuit board and said second printed circuit board, said stiffener panel having a hole therethrough to allow said first electrical connector to removably engage with said second electrical connector, said stiffener panel further having first and second grooves disposed on opposite sides of the hole;

D) a disengagement mechanism attached to said panel, and comprising 1) a first cam assembly disposed in the first groove, and a second cam assembly disposed in the second groove, each cam assembly including a) a cam rotatable about an axis of rotation, b) a cam pin projecting out from opposite sides of said cam, said cam pin being coaxial with the axis of rotation, and c) a torsional helical spring disposed around said cam pin for automatically rotating said cam in a first direction, and 2) a handle attached to each of said cams, and being accessible from between the first printed circuit board and the second printed circuit board, wherein when said handle is pulled, said cams are simultaneously rotated in a second direction opposite to the first direction so that said cams are caused to push against the first printed circuit board, thereby removing said first electrical connector from engagement with said second electrical connector while moving said first printed circuit board in a direction away from said second printed circuit board; and E) a plurality of cover plates, each being disposed over a respective groove and being fastened to said panel, so as to retain said cam pin and said torsional helical spring within the respective groove, each of said cover plates having a hole therein, said cam projecting through the hole within said cover plate when said cams are rotated in the second direction.

25. A computer system, comprising:

a computer housing;

a first component disposed within said housing;

a second component mated to the first component; and a disengagement mechanism that, when activated, moves the first component away from the second component so as to disengage the first component from the second component;

wherein said first component comprises a first printed circuit board having an electrical connector on a surface thereof, said second component being mated to said first printed circuit board via the electrical connector;

wherein said second component comprises a second printed circuit board having a further electrical connector on a surface thereof, said further electrical connector of said second printed circuit board removably engaging with said electrical connector of said first printed circuit board to electrically couple said first printed circuit board to said second printed circuit board;

wherein said disengagement mechanism includes at least one cam assembly, said cam assembly including a cam rotatable about an axis of rotation, whereby rotation of said cam causes said cam to push against the first printed circuit board, thereby removing said further electrical connector of said second printed circuit board from engagement with said electrical connector of said first printed circuit board;

wherein said cam assembly has a cam pin projecting out from opposite sides of said cam, said cam pin being coaxial with the axis of rotation; and wherein said cam assembly further comprises means for automatically urging said cam to a position in which the cam is free of engagement with the first printed circuit board.

26. The computer system of claim 25, wherein said means for automatically urging comprises a torsional helical spring disposed around said cam pin.

* * * * *